US011839897B2

(12) United States Patent
Lei

(10) Patent No.: US 11,839,897 B2
(45) Date of Patent: Dec. 12, 2023

(54) GLUE DISPENSING DEVICE

(71) Applicant: TRIPLE WIN TECHNOLOGY(SHENZHEN) CO. LTD., Shenzhen (CN)

(72) Inventor: Chao-Jie Lei, Shenzhen (CN)

(73) Assignee: TRIPLE WIN TECHNOLOGY(SHENZHEN) CO. LTD., Shenzhen (CN)

( * ) Notice: Subject to any disclaimer, the term of this patent is extended or adjusted under 35 U.S.C. 154(b) by 63 days.

(21) Appl. No.: 17/535,936

(22) Filed: Nov. 26, 2021

(65) Prior Publication Data

US 2022/0362799 A1 Nov. 17, 2022

(30) Foreign Application Priority Data

May 11, 2021 (CN) ..... 202110511162.1

(51) Int. Cl.
*B05C 5/02* (2006.01)
*B05C 11/04* (2006.01)

(52) U.S. Cl.
CPC ..... *B05C 5/0225* (2013.01); *B05C 11/048* (2013.01)

(58) Field of Classification Search
CPC ..... B05C 11/1034; B05C 11/1042; B05C 5/0225; B05C 5/02; B05C 5/001; B05C 11/10; B05C 11/1028; B05C 11/1047; B05B 15/52; B29B 13/02; B29B 13/022
USPC ..... 222/146.5, 504, 309, 108
See application file for complete search history.

(56) References Cited

U.S. PATENT DOCUMENTS 2,247,110 A * 6/1941 Anderson ..... B05B 7/066 53/373.3
3,554,408 A * 1/1971 Fremstad ..... B65B 51/023 222/109
3,662,927 A * 5/1972 Cocks ..... B05C 17/002 219/421
4,387,002 A * 6/1983 Knecht ..... B05C 5/02 118/302
4,461,404 A * 7/1984 Baughman ..... B05B 15/52 141/270
5,240,502 A * 8/1993 Castaldo ..... B05C 5/02 239/114
6,024,250 A * 2/2000 Hickey ..... B05B 15/52 222/63
6,267,157 B1 * 7/2001 Gruson ..... B67C 3/001 141/90

(Continued)

*Primary Examiner* — Charles P. Cheyney
(74) *Attorney, Agent, or Firm* — ScienBiziP, P.C.

(57) ABSTRACT

A glue dispensing device includes a glue container, a first driver, an elastic member, a connecting plate, and a first limiting plate. The glue container includes a containing main body and a glue dispensing head. The glue dispensing head includes a first receiving groove and a dispensing opening. The containing main body includes a second receiving groove and a third receiving groove. The first driver is arranged in the glue container, and includes a piston, a driving portion, and a piston rod. The elastic member is arranged in the second receiving groove. The connecting plate is fixed in the first receiving groove and located at a side of the piston. A first through hole penetrates the connecting plate. The first limiting plate is movably received in the third receiving groove and fixedly sleeved on the piston rod. The elastic member abuts between the connecting plate and the first limiting plate.

9 Claims, 5 Drawing Sheets

(56) References Cited

U.S. PATENT DOCUMENTS

| | | | | |
|---|---|---|---|---|
| 6,478,235 | B1 * | 11/2002 | Soderstrom | D21C 11/12 239/114 |
| 7,874,456 | B2 * | 1/2011 | Bolyard, Jr. | B05C 11/1042 222/61 |
| 8,201,717 | B2 * | 6/2012 | Varga | B05C 9/14 222/593 |
| 9,266,681 | B2 * | 2/2016 | Chau | B29B 13/022 |
| 9,339,839 | B2 * | 5/2016 | Fliess | B05C 5/0225 |
| 9,487,341 | B2 * | 11/2016 | Ineichen | B05B 15/52 |
| 9,725,225 | B1 * | 8/2017 | Fugere | B65D 83/00 |
| 10,486,172 | B2 * | 11/2019 | Saidman | B05C 5/0291 |
| 11,344,903 | B2 * | 5/2022 | Ikushima | B05B 9/0413 |
| 2010/0294810 | A1 * | 11/2010 | Ikushima | B05C 5/0237 222/387 |
| 2013/0105597 | A1 * | 5/2013 | Dunlap | G01F 11/029 239/296 |
| 2014/0252041 | A1 * | 9/2014 | Ikushima | B05C 11/1034 222/309 |
| 2016/0136677 | A1 * | 5/2016 | Carmichael | B05C 11/1042 118/712 |

* cited by examiner

GLUE DISPENSING DEVICE

FIELD

The subject matter herein generally relates to a glue dispensing device.

BACKGROUND

Dispensing technology is widely used in various fields such as micro-assembly, bioengineering, and rapid manufacturing. With the rapid development of electronic products, dispensing technology requires higher precision and greater operability.

Pneumatic dispensing is a commonly used dispensing technology. However, after dispensing, the glue tends to be drawn and remains on the product, which seriously affects the subsequent application of the product.

Therefore, there is room for improvement within the art.

BRIEF DESCRIPTION OF THE DRAWINGS

Implementations of the present disclosure will now be described, by way of embodiments, with reference to the attached figures.

DETAILED DESCRIPTION

Figure 1:
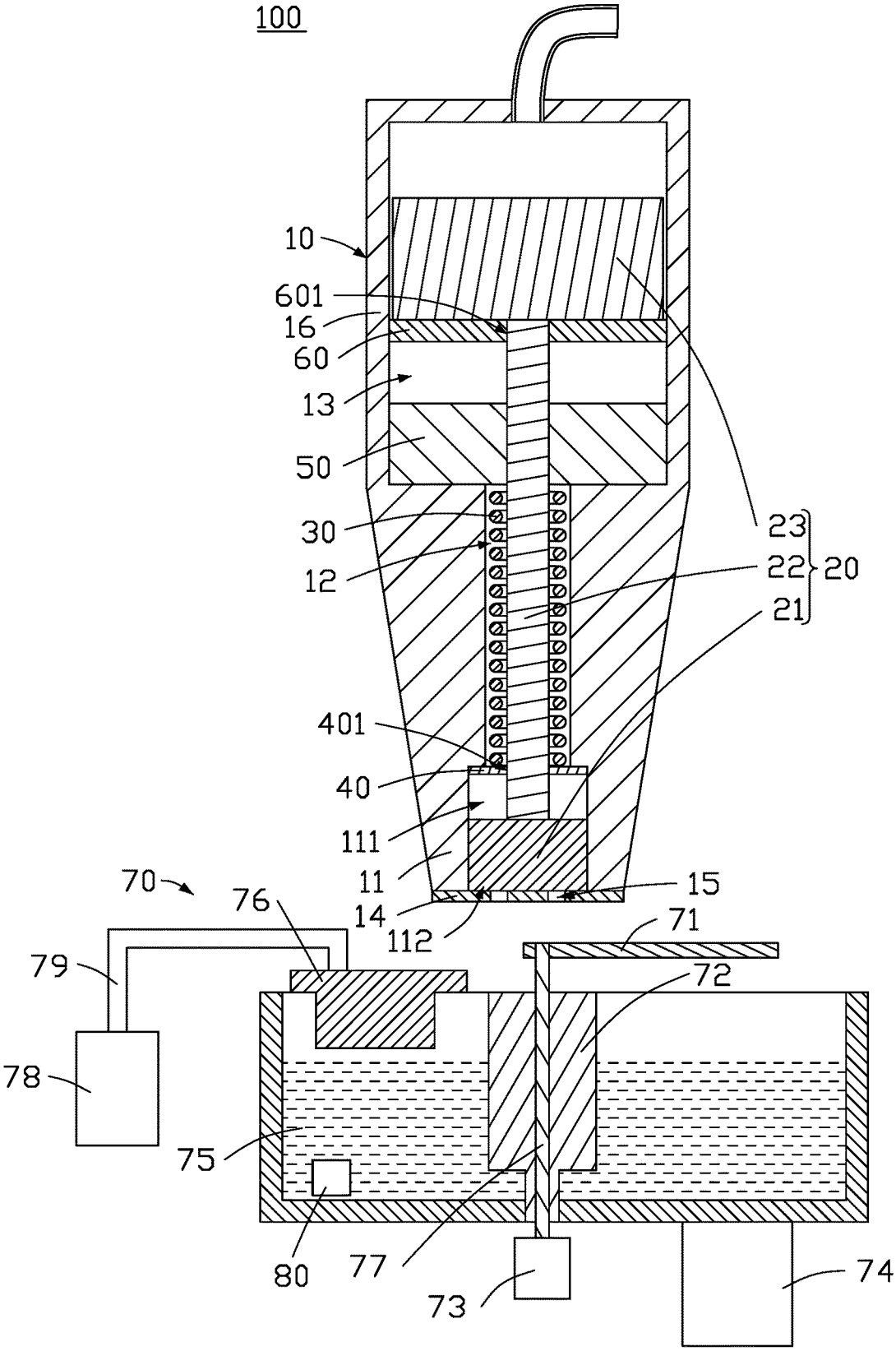
FIG. 1 is a cross-sectional view of an embodiment of a glue dispensing device according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better illustrate details and features of the present disclosure.

The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean "at least one."

The term "comprising," when utilized, means "including, but not necessarily limited to"; it specifically indicates open-ended inclusion or membership in the so-described combination, group, series, and the like.

FIG. 1 illustrates an embodiment of a glue dispensing device 100. The glue dispensing device 100 includes a glue container 10, a first driver 20, an elastic member 30, a connecting plate 40, a first limiting plate 50, a second limiting plate 60, and a squeegee assembly 70. The glue container 10 includes a containing main body 16 and a glue dispensing head 11 connected to an end of the containing main body 16. The glue dispensing head 11 includes a first receiving groove 111 and a dispensing opening 112 communicating with the first receiving groove 111. The first receiving groove 111 is located between the containing main body 16 and the dispensing opening 112. The containing main body 16 includes a second receiving groove 12 and a third receiving groove 13. The second receiving groove 12 is located between the first receiving groove 111 and the third receiving groove 13. The first receiving groove 111, the second receiving groove 12, and the third receiving groove 13 are communicated in that sequence. The first driver 20 is arranged in the glue container 10 to realize glue suction and glue dispense of the glue dispensing head 11.

Figure 2:
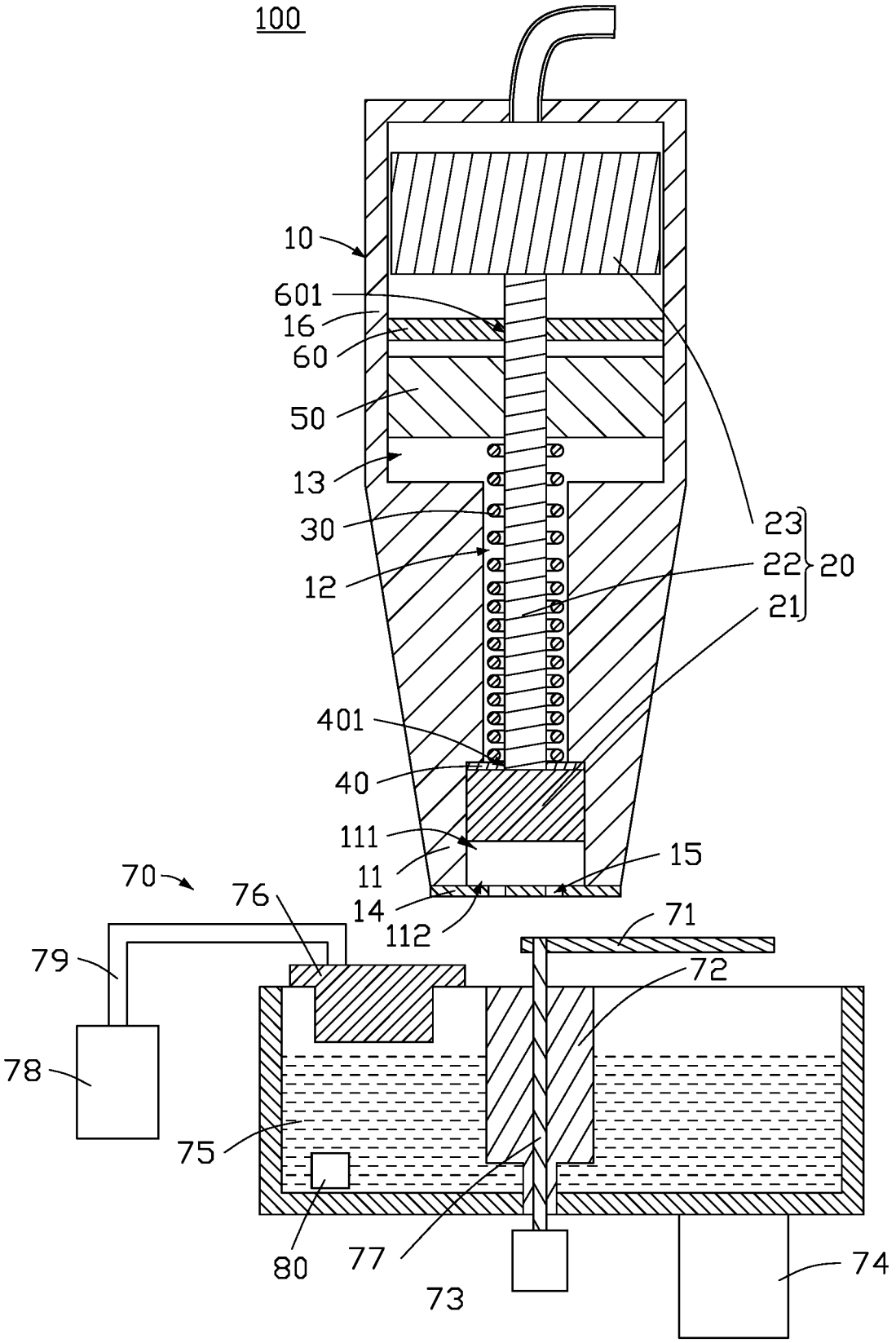
FIG. 2 is a state diagram of the glue dispensing device of FIG. 1 according to the present disclosure.

Referring to FIGS. 1 and 2, the first driver 20 includes a piston 21 received in the first receiving groove 111, a driving portion 23 for driving the piston 21 to reciprocate in the first receiving groove 111, and a piston rod 22 connected to the piston 21 and the driving portion 23. In at least one embodiment, the first driver 20 may be an air cylinder. The driving portion 23 is received in the third receiving groove 13. The piston rod 22 passes through the second receiving groove 12, a first end of the piston rod 22 is received in the first receiving groove 111 to be connected to the piston 21, and a second end of the piston rod 22 facing away from the first end is received in the third receiving groove 13 to be connected to the driving portion 23. An outer diameter of the piston 21 is the same as an inner diameter of the first receiving groove 111 along a same direction.

Referring to FIG. 1, the connecting plate 40 is fixed in the first receiving groove 111 and is located at a side of the piston 21 facing away from the glue dispensing head 11. A first through hole 401 penetrates the connecting plate 40 and is used for the piston rod 22 to pass through.

Referring to FIGS. 1 and 2, the first limiting plate 50 is movably received in the third receiving groove 13 and is fixedly sleeved on the piston rod 22. The elastic member 30 abuts between the connecting plate 40 and the first limiting plate 50. In at least one embodiment, the elastic member 30 may be a spring. The elastic member 30 may be sleeved on the piston rod 22. At least part of the elastic member 30 is received in the second receiving groove 12. When the glue is dispensed from the glue dispensing head 11, the driving portion 23 drives the piston rod 22 and the piston 21 to move toward the dispensing opening 112, and at the same time the first limiting plate 50 moves towards the connecting plate 40, thereby compressing the elastic member 30. A force opposite to a moving direction of the first limiting plate 50 is generated by the elastic member 30, and buffers the driving portion 23 to push the piston 21 to dispense the glue, thereby facilitating a formation of the glue during dispensing. Therefore, when the glue container 10 moves up after dispensing, since the formation of the glue has been completed, a drawing of the glue at the dispensing opening 112 can be reduced, and the dispensing quality can be improved. In at least one embodiment, the elastic member 30 can also prevent part of the glue from flowing downward due to an unstable force generated by the driving portion 23 on the piston 21.

Referring to FIGS. 1 and 2, a diameter of the first limiting plate 50 is greater than a diameter of the second receiving groove 12, so that a stroke of the piston 21 is limited to precisely control the dispensing amount of glue when the first limiting plate 50 moves toward the connecting plate 40.

The second limiting plate 60 is fixedly received in the third receiving groove 13. The second limiting plate 60 is located between the first limiting plate 50 and the driving portion 23. A second through hole 16 is formed to penetrate the second limiting plate 60 and is used for the piston rod 22 to pass through. When the glue dispensing head 11 sucks glue, the driving portion 23 drives the piston 21 to move in a direction away from the dispensing opening 112, and the first limiting plate 50 moves with the piston rod 21 until the first limiting plate 50 abuts against the second limiting plate 60. A distance that the first limiting plate 50 moves upward is limited by the second limiting plate 60, so that a maximum distance between the piston 21 and the dispensing opening 112 is limited, thereby achieving precise control of the glue suction amount of the glue dispensing head 11.

Figure 3:
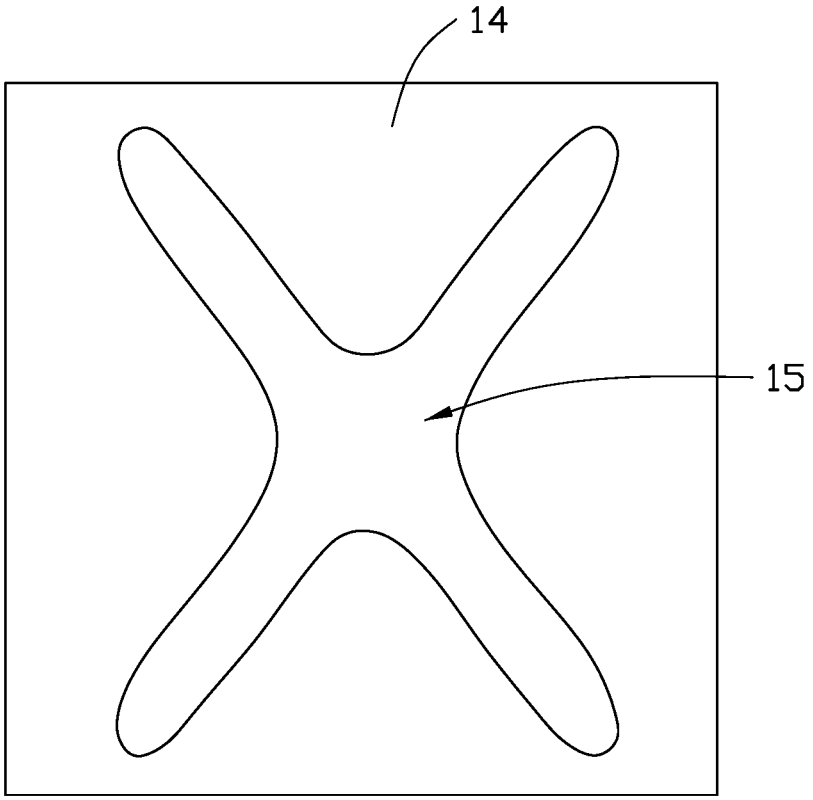
FIG. 3 is a diagram of an embodiment of a glue outlet plate according to the present disclosure.
Figure 4:
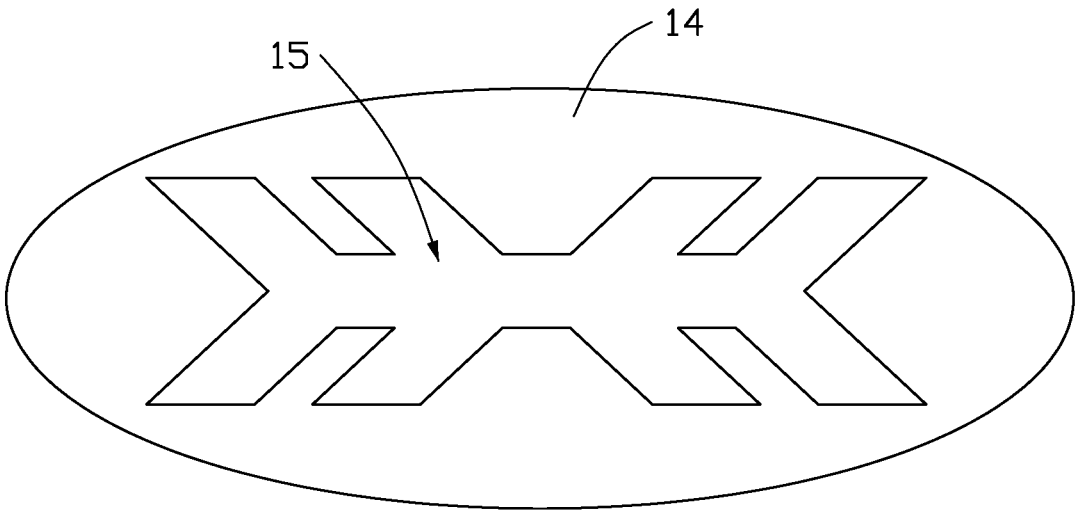
FIG. 4 is a diagram of another embodiment of a glue outlet plate according to the present disclosure.

Referring to FIGS. 1, 3 and 4, the glue dispensing head 11 may further include a glue outlet plate 14 arranged at the dispensing opening 112. At least one slot 15 penetrates the glue outlet plate 14 and communicates with the first receiving groove 111. When the driving portion 23 drives the piston 21 to move toward the dispensing opening 112, the glue in the first receiving groove 111 is squeezed out through the slot 15. Referring to FIGS. 3 and 4, a shape of each of the at least one slot 15 can be varied as needed.

Figure 5:
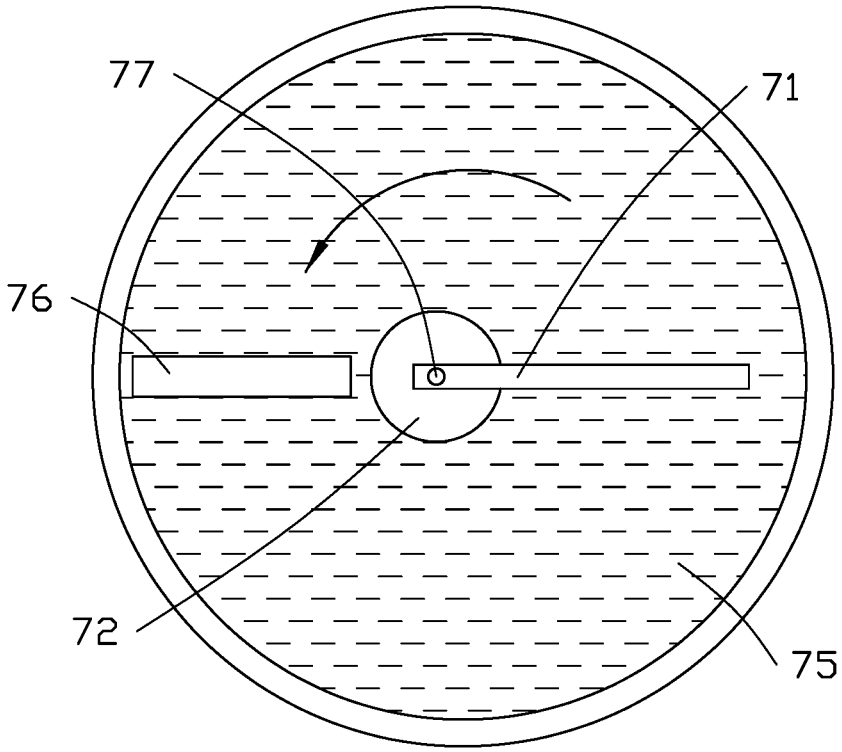
FIG. 5 is a top view of an embodiment of a squeegee assembly according to the present disclosure.

Referring to FIGS. 1 and 5, the squeegee assembly 70 includes a scraper 71 and a second driver 73 for driving the scraper 71 to move back and forth. The squeegee assembly 70 is located at a side of the dispensing opening 112 facing away from the piston 21. The squeegee assembly 70 further includes a platform 72, a rotating shaft 77, a glue storage tank 75, a wiper 76, and a third driver 74. The scraper 71 is arranged on the platform 72 and is used to scrape the excess glue liquid at the glue outlet plate 14 to reduce the drawing of the glue at the glue outlet plate 14. In at least one embodiment, the platform 72 may be cylindrical. The glue storage tank 75 is annularly arranged around the platform 72.

The rotating shaft 77 rotatably passes through the platform 72 and is connected between the scraper 71 and the second driver 73. In at least one embodiment, the second driver 73 may be located at a side of the platform 72 facing away from the scraper 71. In at least one embodiment, the second driver 73 and the third driver 74 may be motors. Preferably, the second driver 73 may be a servo motor. After the glue dispensing head 11 sucks the glue from the glue storage tank 75, the glue container 10 is driven to move to drive the glue dispensing head 11 to move to the top of the scraper 71, so that the glue outlet plate 14 contacts with the scraper 71. At this time, the second driver 73 drives the scraper 71 to reciprocated around the rotating shaft 77, the scraper 71 will scrape the excess glue liquid at the glue outlet plate 14, thereby improving a flatness of the glue when the glue in the glue dispensing head 11 is combined with the product, and precisely controlling the dispensing volume.

In at least one embodiment, the scraper 71 may be fixed on the platform 72, the glue dispensing head 11 may be driven to reciprocate above the scraper 71 to scrape the excess glue liquid at the glue outlet plate 14.

Referring to FIGS. 1 and 5, in order to further control the constant glue suction volume of the glue dispensing head 11, the wiper 76 is arranged above the glue storage tank 75 and contacts the surface of the glue liquid in the glue storage tank 75. The glue storage tank 75 is driven by the third driver 74 to rotate, so that the wiper 76 scrapes the surface of the glue liquid in the glue storage tank 75 flat to avoid the difference in the amount of glue sucked by the glue dispensing head 11 into the first receiving groove 111 due to the uneven surface of the glue liquid in the glue storage tank 75 when the glue dispensing head 11 sucks glue.

Referring to FIG. 1, a lifting cylinder 78 is connected to the wiper 76, and the lifting cylinder 78 drives the wiper 76 to move away from or close to the surface of the glue liquid in the glue storage tank 75. The lifting cylinder 78 is arranged on a side of the glue storage tank 75. The lifting cylinder 78 and the wiper 76 may be connected by a U-shaped supporting rod 79. One end of the supporting rod 79 is fixed on a surface of the wiper 76 facing away from the glue liquid in the glue storage tank 75, and the other end is fixed one the lifting cylinder 78.

In at least one embodiment, in order to detect the liquid level of the glue liquid in the glue storage tank 75, a liquid level sensor 80 may be provided in the glue storage tank 75 for sensing the change of the liquid level of the glue liquid in the glue storage tank 75. In at least one embodiment, a controller (not shown) may be provided, the controller is electrically connected to the liquid level sensor 80 and a switch of the lifting cylinder 78. When the liquid level sensor 80 detects that the liquid level of the glue liquid in the glue storage tank 75 drops, the liquid level sensor 80 transmits a signal to the controller. Then the controller controls the switch of the lifting cylinder 78 to turn on, so that the lifting cylinder 78 drives the wiper 76 to move toward the liquid level of the glue liquid in the glue storage tank 75 to contact with the liquid level of the glue liquid in the glue storage tank 75.

In at least one embodiment, in order to avoid interference between the scraper 71 and the wiper 76 when the scraper 71 moves, the scraper 71 and the wiper 76 are arranged on opposite sides of the platform 72.

When the glue dispensing head 11 need to dispense glue, the driving portion 23 pushes the piston 21 to move toward the dispensing opening 112, so that the distance between the connecting plate 40 and the first limiting plate 50 is gradually reduced, and the elastic member 30 is compressed. In the above process, the elastic member 30 generates a force opposite to the moving direction of the first limiting plate 50 to buffer the driving portion 23 to push the piston 21 to dispense glue, so that the dispensed glue has a buffer time to be gradually formed. That is, when the glue container 10 moves up after dispensing glue, since the dispensed glue has gradually been formed, the drawing of the glue at the dispensing opening 112 can be reduced, and the dispensing quality can be improved.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A glue dispensing device comprising:

a glue container comprising a containing main body and a glue dispensing head connected to an end of the containing main body, wherein the glue dispensing head comprises a first receiving groove and a dispensing opening communicating with the first receiving groove, the first receiving groove is between the containing main body and the dispensing opening; the containing main body comprises a second receiving groove and a third receiving groove, the first receiving groove, the second receiving groove, and the third receiving groove are communicated in that sequence;

a first driver arranged in the glue container, wherein the first driver comprises a piston received in the first receiving groove, a driving portion configured for driving the piston to reciprocate in the first receiving groove, and a piston rod connected to the piston and the driving portion;

an elastic member arranged in the second receiving groove;

a connecting plate fixed in the first receiving groove and located at a side of the piston facing away from the glue dispensing head, wherein a first through hole penetrates the connecting plate and is configured for the piston rod to pass through; and a first limiting plate movably received in the third receiving groove and fixedly sleeved on the piston rod, wherein the elastic member abuts between the connecting plate and the first limiting plate, and the elastic member is compressed when the driving portion drives the piston to move toward the dispensing opening;

wherein the glue dispensing device further comprises a glue storage tank, a wiper, and a tank driver driving the glue storage tank to rotate, the wiper is arranged above the glue storage tank and contacts a surface of glue liquid in the glue storage tank.

2. The glue dispensing device of claim 1, wherein a diameter of the first limiting plate is greater than a diameter of the second receiving groove.

3. The glue dispensing device of claim 2, wherein a second limiting plate is fixedly received in the third receiving groove and located between the first limiting plate and the driving portion, the second limiting plate defines a second through hole configured for the piston rod to pass through.

4. The glue dispensing device of claim 2, wherein the glue dispensing head further comprises a glue outlet plate arranged at the dispensing opening, at least one slot penetrates the glue outlet plate and communicates with the first receiving groove.

5. The glue dispensing device of claim 1, wherein the glue dispensing device further comprises a squeegee assembly, the squeegee assembly comprises a scraper and a second driver configured for driving the scraper to move to scrape excess glue liquid at the glue outlet plate.

6. The glue dispensing device of claim 5, wherein the squeegee assembly further comprises a platform and a rotating shaft, the scraper is arranged on the platform, the rotating shaft rotatably extends through the platform and is connected between the scraper and the second driver.

7. The glue dispensing device of claim 6, wherein the glue storage tank is annularly arranged around the platform.

8. The glue dispensing device of claim 1, wherein a liquid level sensor is arranged in the glue storage tank to detect a change of a liquid level of the glue liquid in the glue storage tank.

9. The glue dispensing device of claim 7, wherein the scraper and the wiper are arranged on opposite sides of the platform.

* * * * *